US008554117B2

(12) United States Patent
Okuda et al.

(10) Patent No.: US 8,554,117 B2
(45) Date of Patent: Oct. 8, 2013

(54) TONER CARTRIDGE WITH SHUTTER OPENING/CLOSING AND IMAGE FORMING APPARATUS USING THE SAME

(75) Inventors: Takeshi Okuda, Osaka (JP); Koichi Mihara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 237 days.

(21) Appl. No.: 13/188,563

(22) Filed: Jul. 22, 2011

(65) Prior Publication Data

US 2012/0027467 A1 Feb. 2, 2012

(30) Foreign Application Priority Data

Jul. 28, 2010 (JP) ..... P2010-169858

(51) Int. Cl.
*G03G 15/08* (2006.01)

(52) U.S. Cl.
USPC ..... 399/262; 399/263

(58) Field of Classification Search
USPC ..... 399/262
See application file for complete search history.

(56) References Cited

U.S. PATENT DOCUMENTS

2005/0175376 A1 8/2005 Sekiguchi
2005/0271425 A1* 12/2005 Shimomura et al. ..... 399/258
2008/0056772 A1* 3/2008 Utsumi et al. ..... 399/254
2008/0170887 A1* 7/2008 Nishimura et al. ..... 399/262
2010/0329747 A1* 12/2010 Kouda ..... 399/262

FOREIGN PATENT DOCUMENTS

| | | |
|---|---|---|
| JP | 08-334977 | 12/1996 |
| JP | 09-134073 | 5/1997 |
| JP | 2001-083802 | 3/2001 |
| JP | 2005-227351 | 8/2005 |
| JP | 2008-134571 | 6/2008 |
| JP | 2008-216360 | 9/2008 |
| JP | 2009-168856 | 7/2009 |

* cited by examiner

*Primary Examiner* — David Gray
*Assistant Examiner* — Tyler Hardman
(74) *Attorney, Agent, or Firm* — Nixon & Vanderhye, P.C.

(57) ABSTRACT

A toner cartridge includes a toner containing section which contains a toner therein; a toner discharging unit which is disposed in one side of the toner containing section and has a toner discharging port; a screw member which is disposed inside the toner containing section and transports a toner inside the toner containing section to the toner discharging unit; a bearing member which holds an end of the screw member; a rotary shutter which is disposed in the toner discharging unit to be rotatable about a rotation axial line of the screw member and has a circular-arc-shaped cross-section; and a shutter opening and closing mechanism which opens the rotary shutter in conjunction with rotation of the screw member.

5 Claims, 9 Drawing Sheets

TONER CARTRIDGE WITH SHUTTER OPENING/CLOSING AND IMAGE FORMING APPARATUS USING THE SAME

CROSS-REFERENCE TO RELATED APPLICATION

This application claims priority to Japanese Patent Application. No. 2010-169858, which was filed on Jul. 28, 2010, the content of which is incorporated herein by reference in its entirety.

BACKGROUND OF THE TECHNOLOGY

1. Field of the Technology

The present technology relates to a toner cartridge for use in an image forming apparatus such as a laser beam printer or a multi-functional peripheral, particularly to a toner cartridge for containing toner disposed so as to be exchangeable such as a toner hopper and a toner bottle, and an image forming apparatus using the same.

2. Description of the Related Art

An image forming apparatus employing electrostatic electrophotography generally includes a charging step, an exposure step, a developing step, a transfer step, a separation step, a cleaning step, a charge removing step, and a fixing step. For example, an image forming process is performed in the following manner. The surface of a rotationally-driven photoreceptor is uniformly charged by a charging device, and a laser beam is emitted from an exposure device to the charged surface of the photoreceptor, so that an electrostatic latent image is formed on the surface. Subsequently, the electrostatic latent image formed on the photoreceptor is developed by a developing device, and a toner image is formed on the surface of the photoreceptor. The toner image on the photoreceptor is transferred onto a transfer material by a transfer device, and then the toner image is heated by a fixing device, so that the toner image is fixed onto the transfer material. Further, the residual toner remaining on the surface of the photoreceptor after the transfer step is removed by a cleaning device and is collected to a predetermined collecting portion. Also, any residual charge remaining on the cleaned surface of the photoreceptor is removed by a charge removing device, and the photoreceptor becomes ready for the next image forming process.

As a developer used for developing the electrostatic latent image formed on the photoreceptor, a one-component developer only containing a toner or a two-component developer containing a toner and a carrier is generally used. Since the one-component developer does not use a carrier, a mixing mechanism or the like for uniformly mixing the toner and the carrier is not needed. Here, although there is an advantage that the developing device becomes simplified, there is a drawback that the charging amount of the toner is difficult to stabilize. Since the two-component developer needs a mixing mechanism or the like for equally mixing the toner and the carrier, there is a drawback that the developing device becomes complicated, but there is an advantage that the stability of the charging amount or the suitability for a high speed machine is excellent. For this reason, the two-component developer has been commonly used in a high-speed image forming apparatus or a color image forming apparatus.

In recent years, a toner having a small particle diameter has been frequently used in order to handle a user's demand for energy saving or high image quality, where the toner has a low softening temperature and a mean diameter of 5 to 9 μm. This type of toner may make the fixing step at a low temperature possible and be effectively used for high image Quality such as high resolution or a reduction of granularity. However, since the flowability of the toner is low, aggregation of the toner is easily generated. In particular, there is a problem in that the flowability of the toner is extremely reduced since an external additive of the toner is buried by friction against a sponge-like supply roller used as a toner discharge member of the toner cartridge.

In order to solve these problems, for example, as disclosed in Japanese Unexamined Patent Publication JP-A 2001-83802 and Japanese Unexamined Patent Publication JP-A 2008-216360, when a screw-like toner discharge member is used instead of the sponge-like supply roller, the friction between the toner and the supply member may be reduced when the toner is supplied. Accordingly, there is hard to occur a problem that the flowability of the toner is extremely reduced due to the burial of the external additive.

However, in the case where the screw-like toner discharge member disclosed in JP-A 2001-83802 and JP-A 2008-216360 is used in the toner cartridge, when a certain vibration is applied to the toner cartridge, there occurs a phenomenon that the toner abruptly leaks even when the toner discharge member does not rotate (when the toner is not supplied) (occasionally referred to as a toner avalanche phenomenon).

FIGS. 9A and 9B are schematic diagrams illustrating states before and after the toner avalanche phenomenon is generated while the rotation of a screw member 503 of an existing toner cartridge 500 using a screw member is stopped. FIG. 9A is a schematic diagram illustrating a state before generation of the toner avalanche phenomenon, and FIG. 9B is a schematic diagram illustrating a state where the toner avalanche phenomenon is generated while the rotation of the screw member 503 is stopped.

A toner cartridge 500 shown in FIGS. 9A and 9B includes a toner containing section 501 which contains a toner T, a toner discharging section 502, a screw member 503, and a slide shutter 504. The toner discharging section 502 is disposed in one side of the toner containing section 501 and has a toner discharging port 502*a*. The screw member 503 is disposed inside the toner containing section 501 and transports the toner T inside the toner containing section 501 to the toner discharging section 502. The slide shutter 504 closes the toner discharging port 502*a*. Then, when the toner cartridge 500 is set to a predetermined position of an image forming apparatus (not shown), the slide shutter 504 slides along the length direction (the direction along a rotation axial line of the screw member 503) of the toner containing section 501. Accordingly, the toner discharging port 502*a* is opened, so that a toner supply pipe 505 disposed in a developing device (not shown) communicates with the toner containing section 501. FIGS. 9A and 9B all illustrate states where the toner discharging port 502*a* is opened so that the toner inside the toner containing section 501 may be supplied to the developing device from the toner supply pipe 505.

In the attachment state of the toner cartridge 500, as shown in FIG. 9A, the toner T around the toner discharging port 502*a* stays inside the toner containing section 501 while maintaining a repose angle. At this time, when a certain vibration or the like is applied to the toner cartridge 500, all of the toner T inside the toner containing section 501 starts to flow due to the vibration or the like. In accordance with the flowing, as shown in FIG. 9B, the air A is mixed with the toner T, so that it enters an aerosol state (a state where a flow resistance is low). Accordingly, the toner T near the toner discharging port 502*a* is dropped into the toner supply pipe 505 all at once, so that the toner C avalanche phenomenon is generated even when the rotation of the screw member 503 is stopped.

SUMMARY OF THE TECHNOLOGY

The technology is made in view of the above problems, and an object thereof is to provide a toner cartridge having a toner leakage preventing mechanism used for preventing a toner avalanche phenomenon and an image forming apparatus having the toner cartridge.

The technology provides a toner cartridge comprising:

a toner containing section which contains a toner therein;

a toner discharging section which is disposed in one side of the toner containing section and has a toner discharging port;

a screw member which is disposed inside the toner containing section and transports a toner inside the toner containing section toward the toner discharging section;

a bearing member which holds an end of the screw member;

a shutter member which is disposed in the toner discharging section to be rotatable about a rotation axial line of the screw member and has a circular-arc-shaped cross-section; and a shutter opening and closing mechanism which opens the shutter member in conjunction with rotation of the screw member.

Since the operation of opening the toner discharging port may be performed in conjunction with rotation of the screw member, a special driving mechanism is not needed and the toner cartridge may be decreased in size. Furthermore, since the toner discharging port is closed by the shutter member when the toner cartridge is shipped, the shutter member is not opened unless the screw member rotates. Therefore, even when a vibration or the like is applied to the toner cartridge immediately after the toner cartridge is mounted on the image forming apparatus, it is possible to prevent the toner avalanche phenomenon where the toner near the toner discharging port is dropped from the toner discharging port all at once in the form of an aerosol.

Further, it is preferable that the shutter opening and closing mechanism holds the shutter member at a position where the toner discharging port is closed, releases a closed state of the toner discharging port conjunction with initial rotation of the screw member, and then holds the shutter member at a position where the toner discharging port is opened.

The closed toner discharging port is opened in conjunction with initial rotation of the screw member, but even when the screw member keeps rotating, the toner may be supplied without any problem since the shutter member is held by the shutter opening and closing mechanism at a position where the toner discharging port is opened.

Furthermore, it is preferable that the shutter opening and closing mechanism includes:

a claw piece which has a claw portion fixed to the shutter member;

an operation piece which is disposed in the screw member and presses the claw piece; and two engaging notch portions disposed at a distance from each other in a circumferential direction of the bearing member, the claw portion being engaged with one of the two engaging notch portions, wherein when the claw portion of the claw piece is engaged with a first engaging notch portion of the two engaging notch portions, the claw piece is located at a position where the claw piece operable by the operation piece and a closed state of the toner discharging port using the shutter member is maintained, and wherein when the screw member starts to rotate, the operation piece presses the claw piece, an engaging state of the claw portion with respect to the first engaging notch portion released, the shutter member opens the toner discharging port in conjunction with rotation of the screw member, and then the claw portion of the claw piece is engaged with a second engaging notch portion of the two engaging notch portions by rotation of the screw member and the claw piece is retreated from a position pressed by the operation piece and an opening state of the toner discharging port using the shutter member is maintained.

When the claw portion of the claw piece is engaged with the first engaging notch portion, the closed state of the toner discharging port using the shutter member is maintained. Then, when the initial rotation of the screw member is started, the operation piece presses the claw piece and the engaging state of the claw portion with respect to the first engaging notch portion is released. When the screw member keeps rotating, the claw piece and the shutter member rotate in conjunction with the rotation of the screw member, and the toner discharging port is gradually opened. Subsequently, when the claw portion of the claw piece reaches the second engaging notch portion with the rotation of the screw member, the claw portion is engaged with the second engaging notch portion and the claw piece is retreated from a position where the claw piece is operable by the operation piece. At the same time, the toner discharging port is completely opened. Accordingly, even when the screw member keeps rotating in this state, the shutter member is not operated with the rotation of the screw member, and the opening state of the toner discharging port is maintained.

Furthermore, it is preferable that a length of the first engaging notch portion along the rotation axial line is shorter than a length of the second engaging notch portion along the rotation axial line.

Further, it is preferable that the claw piece is formed of an elastically deformable member.

The degree to which the claw portion of the claw piece is engaged with the engaging notch portion differs in accordance with a difference in depth between the first engaging notch portion and the second engaging notch portion along the rotation axial line. Accordingly, the claw piece may simply perform the setting of the position where the claw piece is operable by the operation piece and a position where the claw piece is retractable from the position where the claw piece is operable. Then, according to the configuration in which the claw piece is formed of an elastically deformable member, the claw portion may be engaged with each engaging notch portion without applying an external force for the engaging operation due to the elastic restoration action of the member and each engaging state is stably maintained.

The technology provides an image forming apparatus employing electrophotography comprising:

a photoreceptor drum on which an electrostatic latent image is to be formed;

a developing device which forms a toner image by supplying a toner to the electrostatic latent image formed on a surface of the photoreceptor drum;

the toner cartridge mentioned above, the toner cartridge supplying a toner to the developing device via a toner supply member;

a transfer device which transfers the toner image on the surface of the photoreceptor drum to a recording medium; and a fixing device which fixes the toner image onto the recording medium.

In the image forming apparatus, an image forming process is performed according to such electrophotography that an electrostatic latent image is formed on the surface of the photoreceptor drum, the electrostatic latent image is developed by the developing device to form a toner image, the toner image is transferred onto a recording medium by the transfer device, and the toner image is fixed by the fixing device. During the image forming process, the screw member inside the toner cartridge is frequently operated, so that the toner is supplied from the toner cartridge to the developing device. Then, since the toner discharging port is still closed by the shutter member immediately after the toner cartridge is set to the image forming apparatus, even when a vibration or the like is applied to the toner cartridge, the toner may be prevented from flowing into the developing device. Accordingly, since toner concentration may be stably controlled, the image density is stable over a long period of time.

Since the operation of opening the toner discharging port may be performed by the rotation of the screw member, a special driving mechanism is not needed and the toner cartridge may be decreased in size. Furthermore, since the toner discharging port is closed when the toner cartridge is shipped, it is possible to reliably prevent the toner avalanche phenomenon that the toner near the toner discharging port is dropped from the toner discharging port all at once in the form of an aerosol immediately after the toner cartridge is set to the image forming apparatus.

BRIEF DESCRIPTION OF THE DRAWINGS

Other and further objects, features, and advantages of the technology will be more explicit from the following detailed description taken with reference to the drawings wherein:

FIGS. 9A and 9B are schematic diagrams illustrating states before and after the toner avalanche phenomenon is generated while the rotation of a screw member of an existing toner cartridge using a screw member is stopped, wherein FIG. 9A is a schematic diagram illustrating a state before generation of the toner avalanche phenomenon, and FIG. 9B is a schematic diagram illustrating a state where the toner avalanche phenomenon is generated while the rotation of the screw member is stopped.

DETAILED DESCRIPTION

Figure 1:
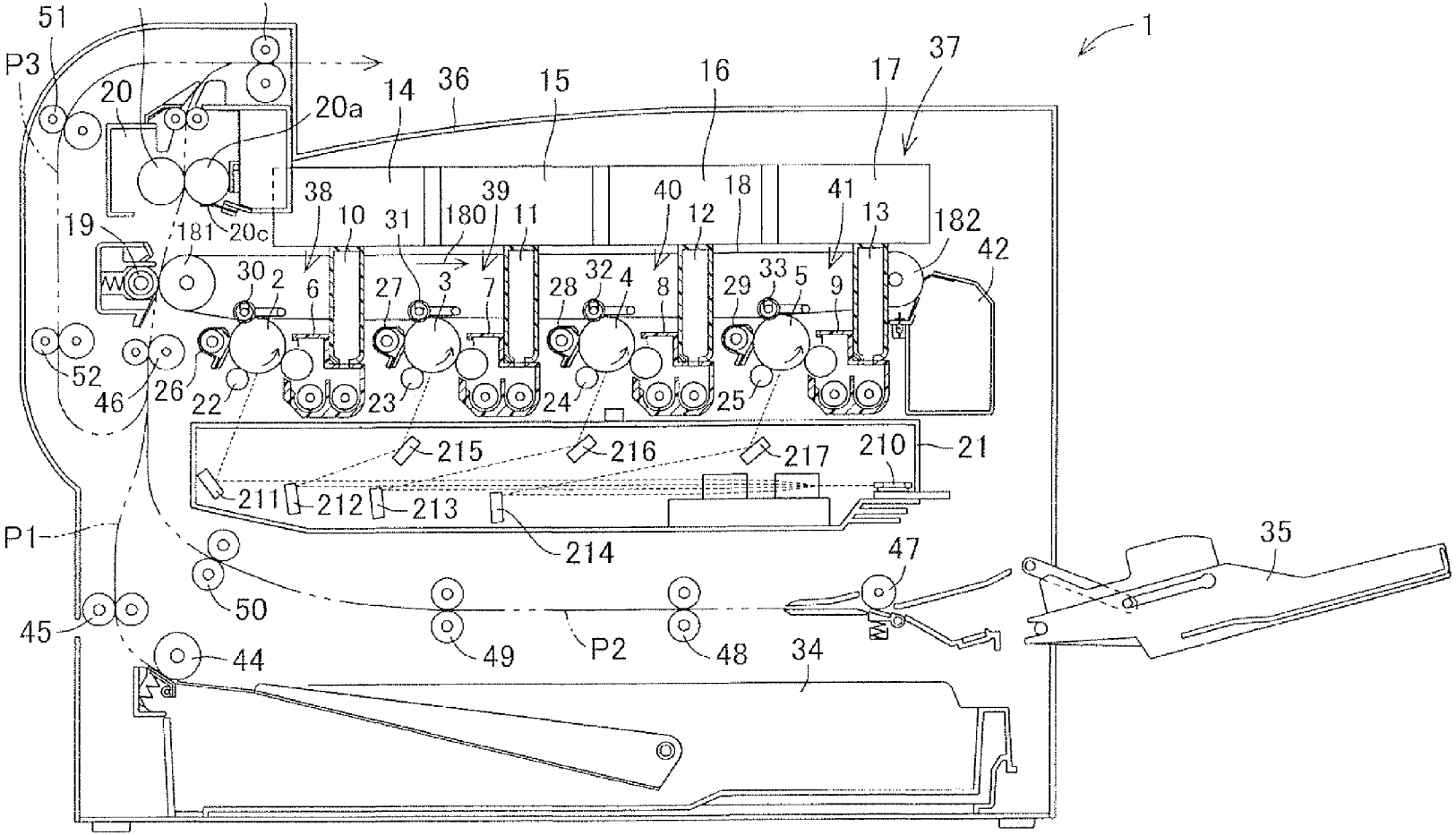
FIG. 1 is a diagram illustrating an overall configuration of an image forming apparatus according to an embodiment.

Hereinafter, preferred embodiments will be described by referring to the accompanying drawings. First, a configuration of an image forming apparatus 1 according to the embodiment will be described by referring to FIG. 1. FIG. 1 is a diagram illustrating an overall configuration of the image forming apparatus 1 according to the embodiment. The image forming apparatus 1 according the embodiment includes: photoreceptor drums 2 to 5 on which an electrostatic latent image is to be formed; developing devices 6 to 9 which form toner images by supplying a toner to the electrostatic latent images formed on the surfaces of the photoreceptor drums 2 to 5; toner cartridges 14 to 17 which supply a toner to the developing devices 6 to 9 via toner supply pipes 10 to 13 as toner supply members; a secondary transfer roller 19 which is a transfer device configured to transfer the toner images on the surfaces of the photoreceptor drums 2 to 5 to a paper sheet via an intermediate transfer belt 18; and a fixing device 20 which fixes the toner images on the paper sheet, and is configured to form an image using a toner by employing electrophotography. Then, the toner cartridges 14 to 17 used in the image forming apparatus 1 have specific constitution as described below.

The image forming apparatus 1 according to the embodiment is configured to form an image having a multiple color or a monochrome color as a visible image on a predetermined sheet (a recording paper sheet) as a recording medium on the basis of image data included in an input command such as image data transmitted from an external device via a communication network or the like. As shown in FIG. 1, the image forming apparatus 1 includes: an exposure unit 21; the photoreceptor drums 2 to 5 which correspond to image bearing members having latent images formed by the exposure unit 21; developing devices 6 to 9; charging rollers 22 to 25; cleaning units 26 to 29; the intermediate transfer belt 18; primary transfer rollers 30 to 33; secondary transfer roller 19; the fixing device 20; paper conveyance paths P1, P2, and 23; a paper feeding cassette 34; a manual paper feeding tray 35; a paper discharge tray 36; and a toner cartridge unit 37.

Image data of a color image as a target of the image forming apparatus 1 forms a visible image in the image forming sections 38 to 41 by using image data corresponding to each color of four colors of black (K), cyan (C), magenta (M), and yellow (Y). The image forming sections 38 to 41 are used to form a color image by using the respective colors. Accordingly, four charging rollers 22 to 25, four photoreceptor drums 2 to 5, and four developing devices 6 to 9 are arranged to form four types of latent and toner images in accordance with the respective colors, and also four cleaning units 26 to 29 and four primary transfer rollers 30 to 33 are arranged to correspond thereto. The image forming sections 38 to 41 have the same configuration. For example, the black image forming section 38 includes the photoreceptor drum 2, the developing device 6, the charging roller 22, the transfer roller 30, the cleaning unit 26, and the like.

The image forming sections 38 to 41 are arranged side y side along a moving direction of the intermediate transfer belt 18 (sub-scanning direction). Furthermore, in the image forming sections 38 to 41, the reference numeral 38 corresponds to black, the reference numeral 39 corresponds to cyan, the reference numeral 40 corresponds to magenta, and the reference numeral 41 corresponds to yellow, and four image stations are formed by the respective sections that are distinguished from each other by their reference numerals.

The exposure unit 21 as an exposure device of the embodiment includes a semiconductor laser which is a laser beam source (not shown), a polygon mirror 210, first reflection mirrors 211 to 214, second reflection mirrors 215 to 217, and the like, and emits optical beams such as laser beams modulated by image data of colors of black, cyan, magenta, and yellow to the photoreceptor drums 2 to 5, respectively. Electrostatic latent images are respectively formed on the photoreceptor drums 2 to 5 by image data of colors of black, cyan, magenta, and yellow.

In the embodiment, the exposure unit 21 is of a type using a laser scanning unit (LSU) including a laser emitting portion and a reflection mirror, but a type disposing light emitting elements in an array, for example, a type using an EL or LED recording head may be used.

The photoreceptor drums 2 to 5 are arranged above the exposure unit 21, are image bearing members each having a substantially cylinder shape, and are controlled to rotate in a predetermined direction (refer to an arrow attached to each of the photoreceptor drums 2 to 5) by a driving section and a control section which are not shown. The photoreceptor drums 2 to 5 are so configured that a photoconductive layer is formed on a conductive substrate. For example, a metal drum made of aluminum or the like is the substrate, and on the outer circumferential surface thereof, the photoconductive layer of amorphous silicon (a-Si), selenium (Se), or organic photosemiconductor (OPC) etc., is formed as a thin film. Note that, the configuration of the photoreceptor drums 2 to 5 is not particularly limited to the above-described configuration. The charging rollers 22 to 25 are chargers of a contact type which charge the surfaces of the photoreceptor drums 2 to 5 uniformly to predetermined potential. In the embodiment, as shown in FIG. 1, although charging rollers 22 to 25 of a roller type and the contact type are used as the chargers, in replacement of such charging rollers 22 to 25, chargers of a charger type or a brush type may be used.

The developing devices 6 to 9 supply toner to the surfaces of the photoreceptor drums 2 to 5 on which the electrostatic latent images are formed, to develop the electrostatic latent images to the toner images. Each of the developing devices 6 to 9 contains toner of each of the colors of black, cyan, magenta, and yellow, and visualize the electrostatic latent image corresponding to each of the colors formed on each of the surfaces of the photoreceptor drums 2 to 5 into the toner image of each of the colors of black, cyan, magenta and yellow. The cleaning units 26 to 29 remove and collect residual toners on the surfaces of the photoreceptor drums 2 to 5 with a lubricant or the like after development and image transfer.

The intermediate transfer belt 18 arranged above the respective photoreceptor drums 2 to 5 is supported around a driving roller 181 and a driven roller 182 with tension, and forms a loop-shaped moving path. The photoreceptor drum 5 (yellow), the photoreceptor drum 4 (magenta), the photoreceptor drum 3 (cyan) and the photoreceptor drum 2 (black) are arranged in this order to face the outer circumferential surface of the intermediate transfer belt 18 along with a moving direction 180 thereof. The primary transfer rollers 30 to 33 are arranged at positions facing the respective photoreceptor drums 2 to 5 with the intermediate transfer belt 18 interposed therebetween. The respective positions at which the intermediate transfer belt 18 faces the photoreceptor drums 2 to 5 are primary transfer positions. The intermediate transfer belt 18 is a film having a thickness of about 100 to 150 μm, and formed to be an endless-shape. A primary transfer bias having opposite polarity to charging polarity of the toner is applied by constant voltage control to the primary transfer rollers 30 to 33 in order to transfer the toner images borne on the surfaces of the photoreceptor drums 2 to 5 onto the intermediate transfer belt 18. Thereby, the toner images of the respective colors formed on the photoreceptor drums 2 to 5 are overlapped and transferred onto the outer circumferential surface of the intermediate transfer belt 18 sequentially, and a full-color toner image is formed on the outer circumferential surface of the intermediate transfer belt 18.

However, when image data for only a part of the colors of yellow, magenta, cyan and black is inputted, electrostatic latent images and toner images are formed at only a part of the photoreceptor drums corresponding to the color of the input image data among the four photoreceptor drums 2 to 5. For example, during monochrome image formation, formation of an electrostatic latent image and formation of a toner image are performed only at the photoreceptor drum 2 corresponding to the color of black, and only a black toner image is transferred onto the outer circumferential surface of the intermediate transfer belt 18.

Each of the primary transfer rollers 30 to 33 is configured by coating a surface of a shaft whose raw material is metal having a diameter of 8 to 10 mm (stainless steel, for example) with a conductive elastic material (such as EPDM, urethane foam, etc.), and applies high voltage uniformly to the intermediate transfer belt 18 by the conductive elastic material. In the embodiment, although the primary transfer rollers 30 to 33 are used as transfer electrodes, other than them, a brush or the like is also usable. The toner image transferred onto the outer circumferential surface of the intermediate transfer belt 18 at each primary transfer position is conveyed to a secondary transfer position, which is a position facing the secondary transfer roller 19, by the rotation of the intermediate transfer belt 18 along the moving direction 180. The secondary transfer roller 19 is in pressure-contact, at a predetermined nip pressure, with the outer circumferential surface of the intermediate transfer belt 18 whose inner circumferential surface is in contact with a circumferential surface of a driving roller 181 during image formation. To obtain the nip pressure constantly, either of the secondary transfer roller 19 or the driving roller 181 is formed by a hard material such as metal, and another one is formed by a soft material such as an elastic roller or the like (elastic rubber roller, foamable resin roller, etc.).

When a paper sheet fed from the paper feeding cassette 34 or the manual paper feeding tray 35 passes through between the secondary transfer roller 19 and the intermediate transfer belt 18, high voltage with opposite polarity (+) to the charging polarity of the toner (−) is applied to the secondary transfer roller 19. As described above, the electrostatic latent images formed on the surfaces of respective photoreceptor drums 2 to 5 are visualized by the toner corresponding to each of the colors to form respective toner images, and such toner images are layered on the intermediate transfer belt 18. Thereafter, the layered toner images are moved to a contact position of the conveyed paper sheet with the intermediate transfer belt 18 by the rotation movement of the intermediate transfer belt 18, and by the secondary transfer roller 19 arranged in this position, the toner images are transferred from the outer circumferential surface of the intermediate transfer belt 18 onto the paper sheet.

Toners adhered to the intermediate transfer belt 18 by the contact of the intermediate transfer belt 18 with the photoreceptor drums 2 to 5, and toners remaining on the intermediate transfer belt 18 without being transferred in transferring the toner image from the intermediate transfer belt 18 to the paper sheet become a source of causing color mixture of the toner at the next step, therefore removal and collection thereof are performed by an intermediate transfer belt cleaning unit 42. The intermediate transfer belt cleaning unit 42 is provided with, for example, a cleaning blade as a cleaning member that is in contact with the intermediate transfer belt 18. A part of the intermediate transfer belt 18 where the cleaning blade is in contact therewith is supported by a driven roller 182 from a backside thereof.

The paper sheet to which a toner image is transferred as a visible image is guided by the fixing device 20 comprised of a heating roller 20*a* and a pressure roller 20*b*, passes through between the heating roller 20*a* and the pressurizing roller 20*b*, and subjected to the processing of heating and pressurizing. Thereby, the toner image to be the visible image is fixed firmly on the surface of the paper sheet. The paper sheet on which the toner image has been fixed is discharged by paper discharge rollers 43 onto the paper discharge tray 36. On the heating roller 20*a*, a temperature sensor (such as thermistor, for example) 20*c* is provided, and based on surface temperature detection information of the heating roller 20*a* by the temperature sensor, heat generation control in a heat generating section of the heating roller 20*a* is performed by a control section (not shown).

The image forming apparatus 1 is provided with the paper conveyance path 21 of a substantially vertical direction so that the paper sheet contained in the paper feeding cassette 34 is fed, through between the secondary transfer roller 19 and the intermediate transfer belt 18 and through the fixing device 20, to the paper discharge tray 36. Arranged in the paper conveyance path 21 are a pick-up roller 44 for feeding the paper in the paper feeding cassette 34 into the paper conveyance path 21 sheet by sheet, conveying rollers 45 for conveying the fed paper sheet upward, registration rollers 46 for guiding the conveyed caper sheet between the secondary transfer roller 19 and the intermediate transfer belt 18 at a predetermined timing, and the paper discharge rollers 43 for discharging the paper sheet to the paper discharge tray 36. In addition, inside the image forming apparatus 1, the paper conveyance path P2 on which a pick-up roller 47 and conveyance rollers 48 to 50 are arranged is formed between the manual paper feeding tray 35 and the registration rollers 46. Further, the paper conveyance path P3 is formed from the paper discharge rollers 43 to an upstream side of the registration rollers 46 in the paper conveyance path P1.

The paper discharge rollers 43 are rotatable in both forward and reverse directions, and are driven in the forward direction to discharge a paper sheet to the paper discharge tray 36 during single-sided image formation in which an image is formed on one side of the paper sheet, and during second side image formation of double-sided image formation in which an image is formed on both sides of the paper sheet. On the other hand, during first side image formation of the double-sided image formation, the paper discharge rollers 43 are driven in the forward direction until a tail end of the paper sheet passes through the fixing device 20, and are then driven in the reverse direction to guide the paper sheet in the paper conveyance path P3 in a state where the tail end of the paper sheet is held. In the paper conveyance path P3, a reverse conveyance rollers 51 and 52 are arranged and with these reverse conveyance rollers 51 and 52, the paper sheet on which an image has been formed only on one side during double-sided image formation is guided from the paper conveyance path P3 to the paper conveyance path P1 in a state where the paper is turned over and upside down.

The registration rollers 46 guide a paper sheet fed from the paper feeding cassette 34 or the manual paper feeding tray 35 or a paper sheet conveyed via the paper conveyance path P3 toward a region between the secondary transfer roller 19 and the intermediate transfer belt 18 at a timing synchronized with the rotation of the intermediate transfer belt 18. Accordingly, the rotation of the registration rollers 46 is stopped when the operation of the photoreceptor drums 2 to 5 or the intermediate transfer belt 18 is started, and a movement of a paper sheet fed or conveyed prior to the rotation of the intermediate transfer belt 18 inside the paper conveyance path P1 is stopped while a front end thereof comes into contact with the registration rollers 46. Subsequently, the rotation of the registration rollers 46 are started at a timing at which the front end of the paper sheet faces the front end of the toner image formed on the intermediate transfer belt 18 at a position where the secondary transfer roller 19 and the intermediate transfer belt 18 come into pressure-contact with each other.

Furthermore, during a full-color image forming operation for performing image formation in all of the image forming sections 38 to 42, the primary transfer rollers 30 to 33 allow the intermediate transfer belt 18 to come into pressure-contact with all of the photoreceptor drums 2 to 5. On the other hand, during a monochrome image forming operation for performing image formation only in the image forming section 38, only the primary transfer roller 30 allows the intermediate transfer belt 18 to come into pressure-contact with the photoreceptor drum 2.

Figure 2:
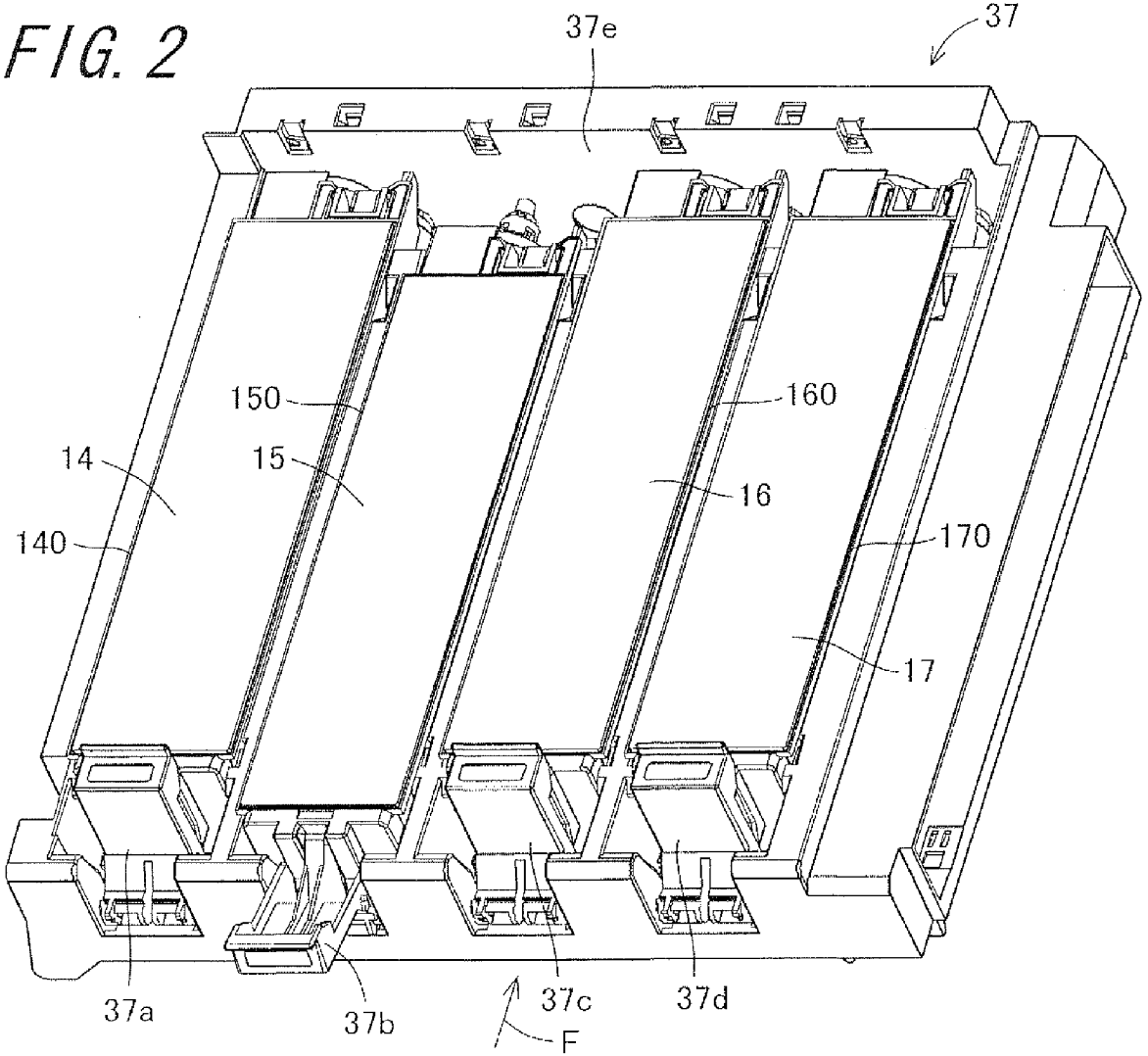
FIG. 2 is a perspective view illustrating a configuration of a toner cartridge unit including toner cartridges mounted on the image forming apparatus shown in FIG. 1.

Next, a configuration of the toner cartridges 14 to 17 according to the embodiment will be described by referring to the drawings. FIG. 2 is a perspective view illustrating a configuration of the toner cartridge unit 37 obtained by integrating four toner cartridges 14 to 17. As shown in FIG. 2, the toner cartridges 14 to 17 are arranged side by side on the toner cartridge unit 37. In each of the toner cartridges 14 to 17, toner containing sections 140 to 170 are configured to be held while being moved in the direction depicted by the arrow F and pressed against a stopper plate 37*e* in a manner such that any one of the corresponding lock levers 37*a* to 37*d* disposed in the toner cartridge unit 37 is lifted upward. In this manner, the toner cartridge unit 37 obtained by arranging side by side four toner cartridges 14 to 17 thereon is installed above the intermediate transfer belt 18. In this installed state, the toner containing sections 140 to 170 are respectively connected to the toner supply pipes 10 to 13, so that there is achieved a state where the corresponding toner may be supplied to the developing devices 6 to 9 via the toner supply pipes 10 to 13. Note that, FIG. 2 illustrates a state before the toner cartridge 15 for cyan is set at a predetermined position.

Figure 3:
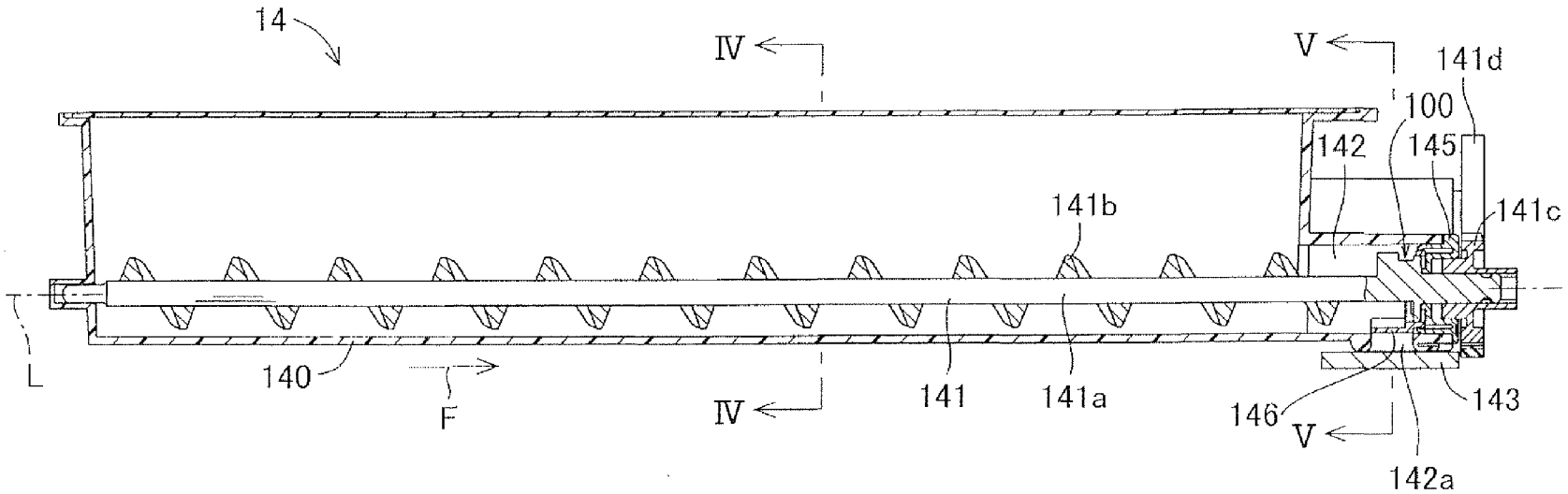
FIG. 3 is a cross-sectional view illustrating a state before the toner cartridge is attached to the image forming apparatus.
Figure 4:
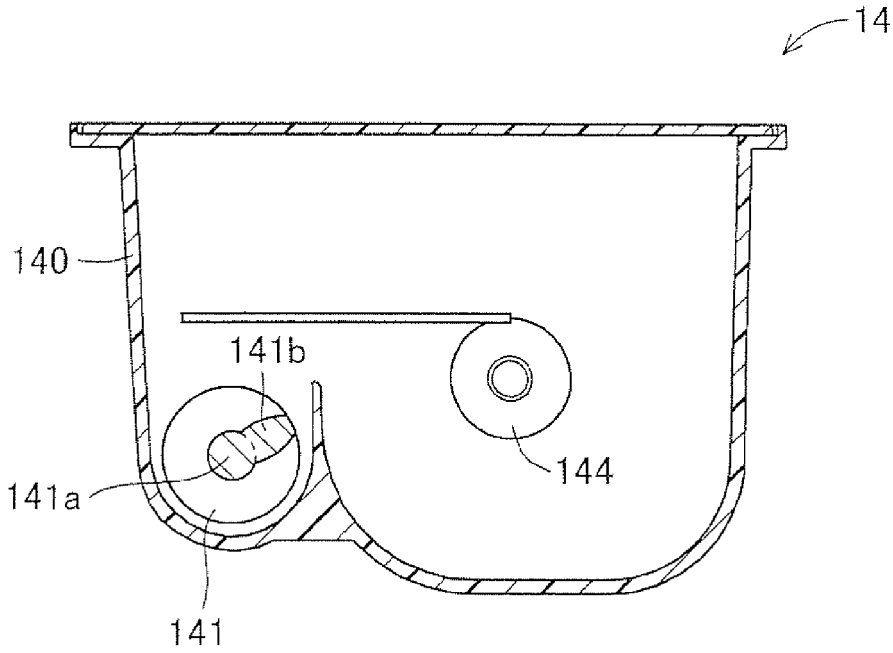
FIG. 4 is a cross-sectional view taken along the line IV-IV of FIG. 3.
Figure 5A:
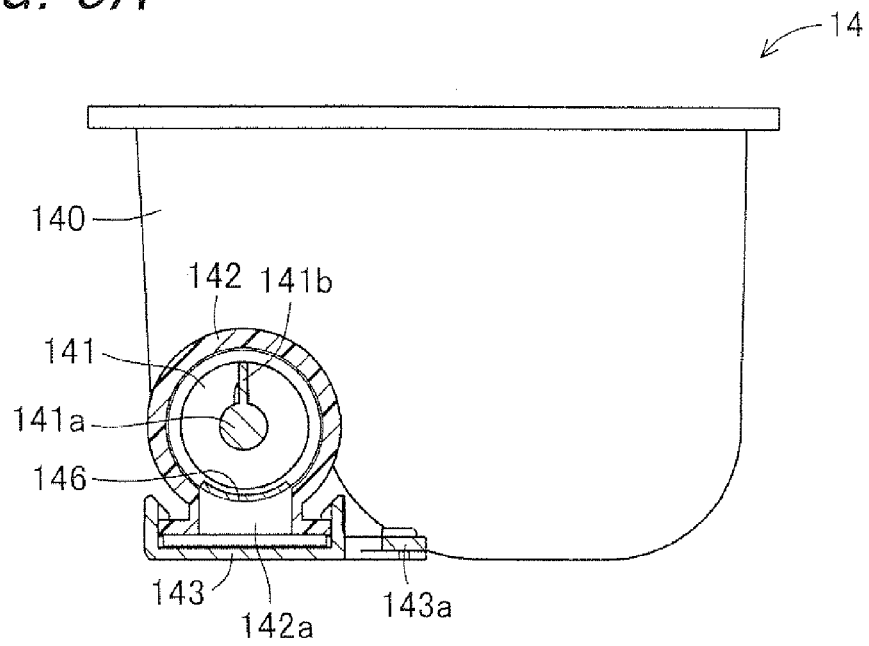
FIG. 5A is a cross-sectional view taken along the line V-V of FIG. 3.
Figure 5B:
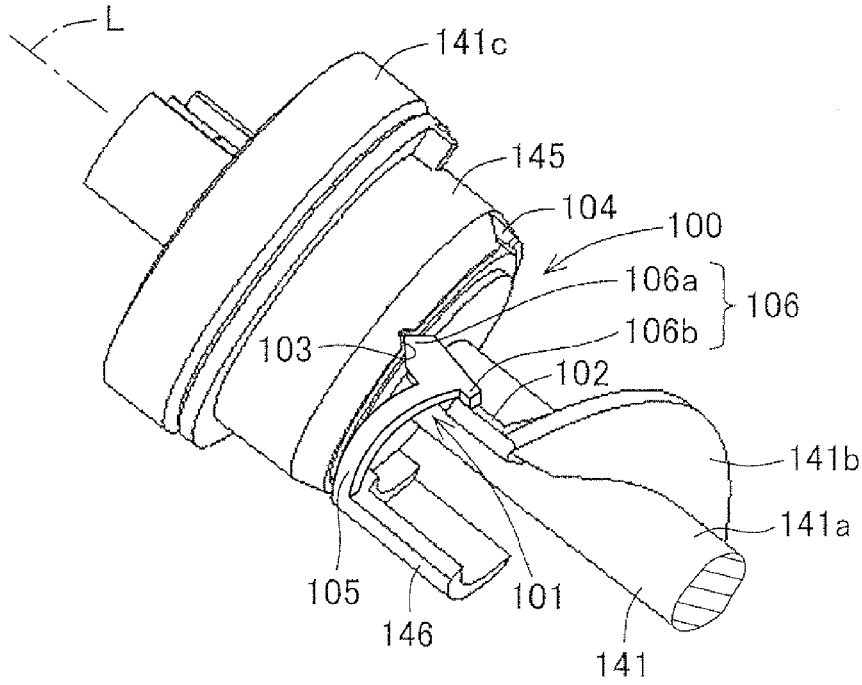
FIG. 5B is a perspective view illustrating a configuration of a shutter opening and closing mechanism.
Figure 6A:
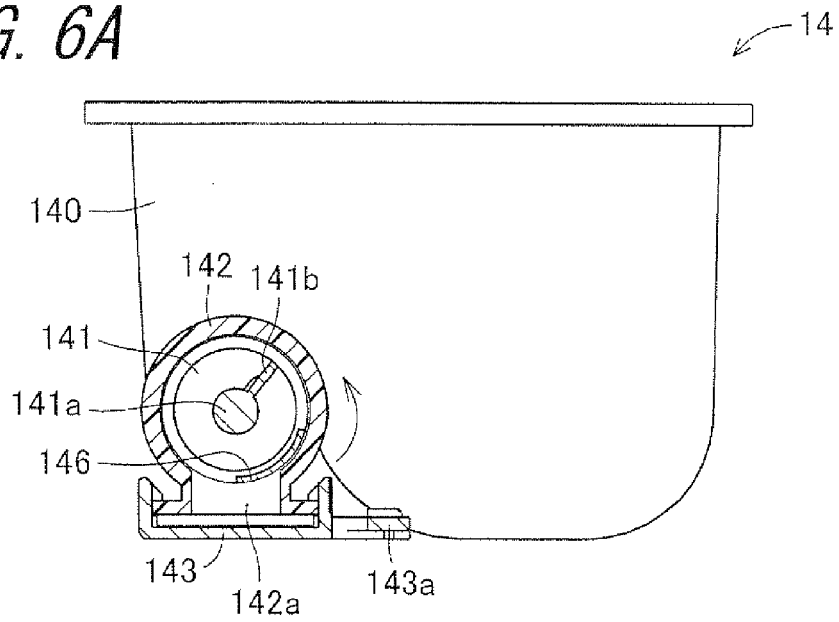
FIG. 6A is a cross-sectional view illustrating a procedure of an opening operation of a rotary shutter.
Figure 6B:
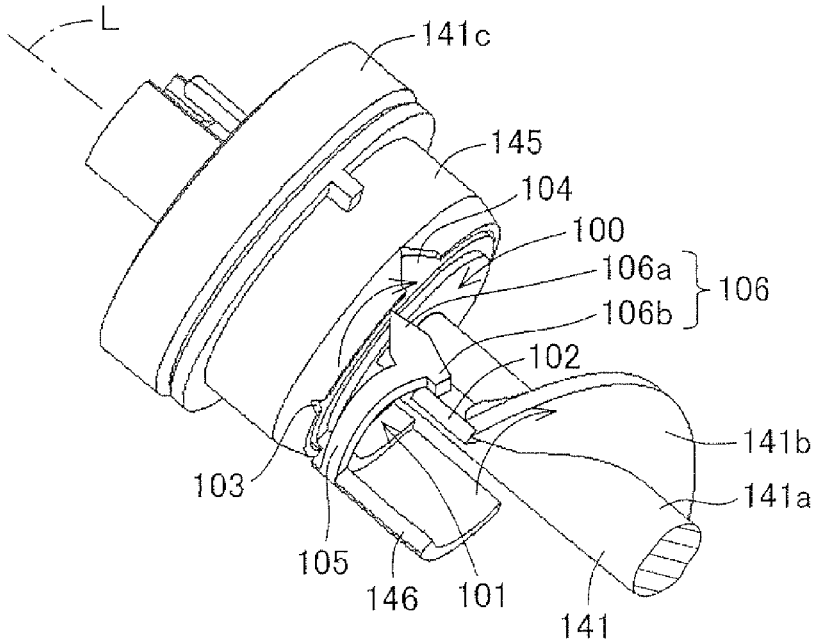
FIG. 6B is a perspective view illustrating an operation state of the shutter opening and closing mechanism corresponding to the operation procedure of the rotary shutter.
Figure 7A:
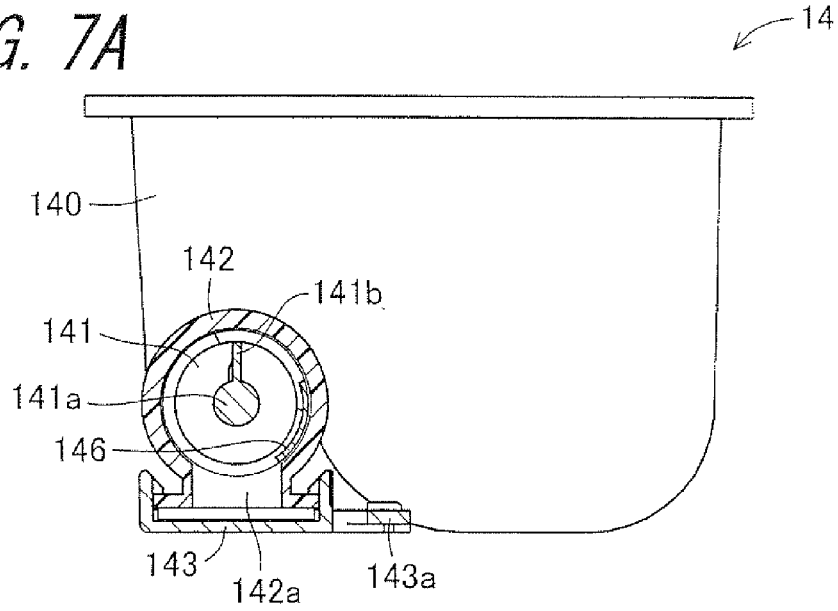
FIG. 7A is a cross-sectional view illustrating a state where the rotary shutter is opened.
Figure 7B:
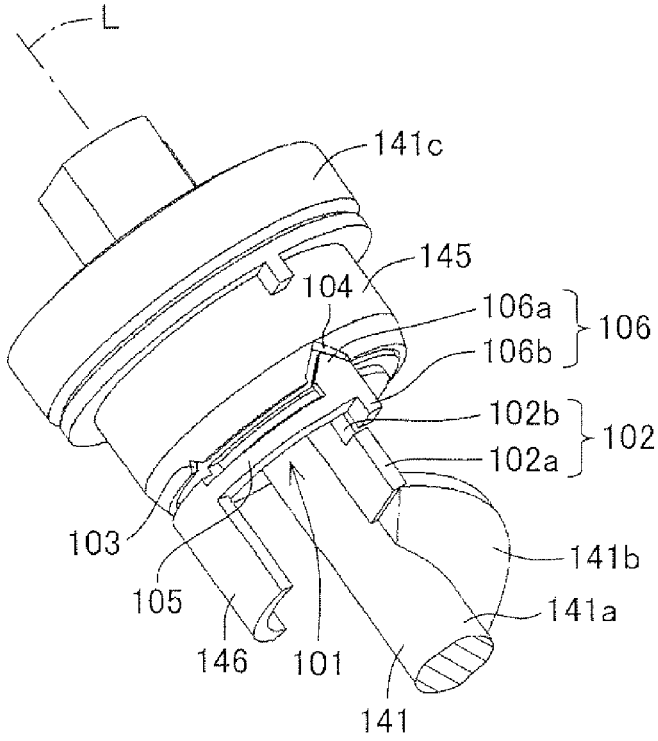
FIG. 7B is a perspective view illustrating an operation state of the shutter opening and closing mechanism while the rotary shutter is opened.
Figure 8A:
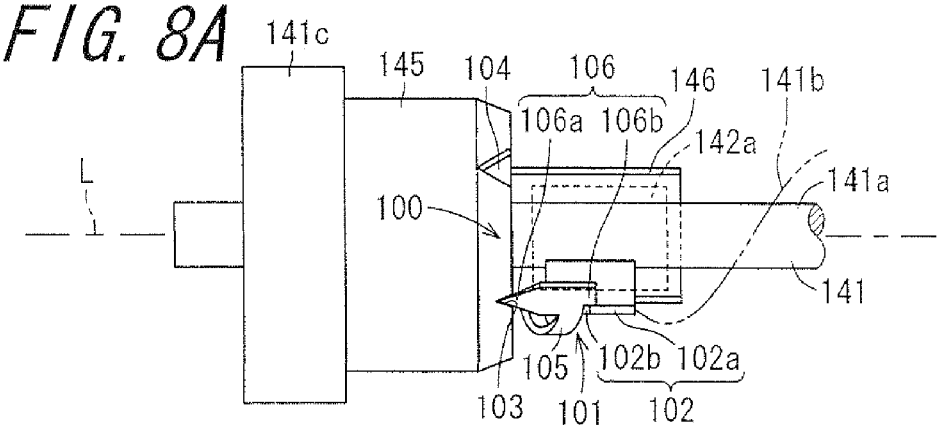
FIGS. 8A to 8C are schematic plan views illustrating an operation state of the rotary shutter and the shutter opening and closing mechanism respectively shown in FIGS. 5A, 5B, 6A, 6B, 7A and 7B.
Figure 8B:
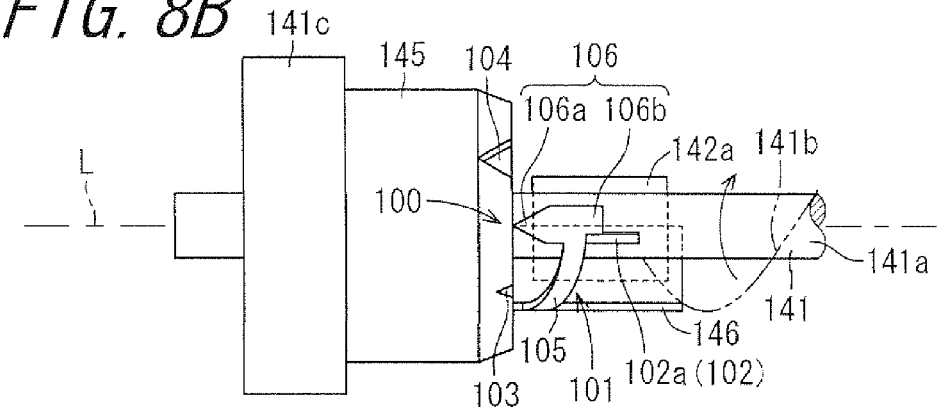
Figure 8C:
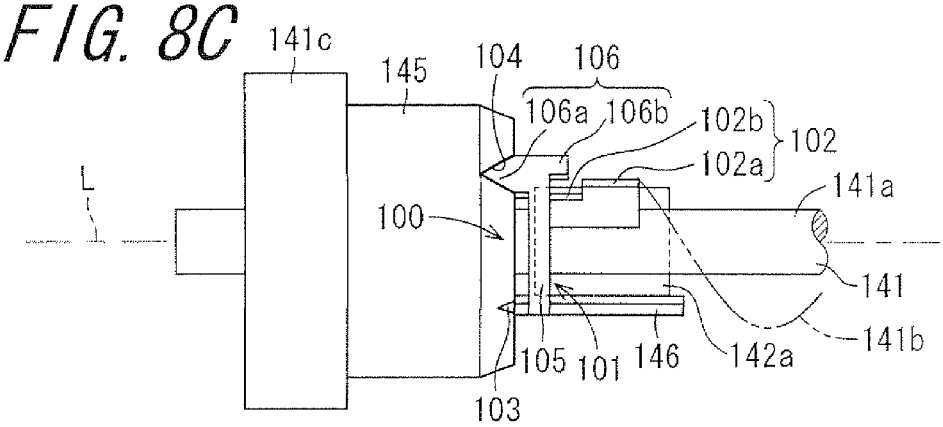
Figure 9A:
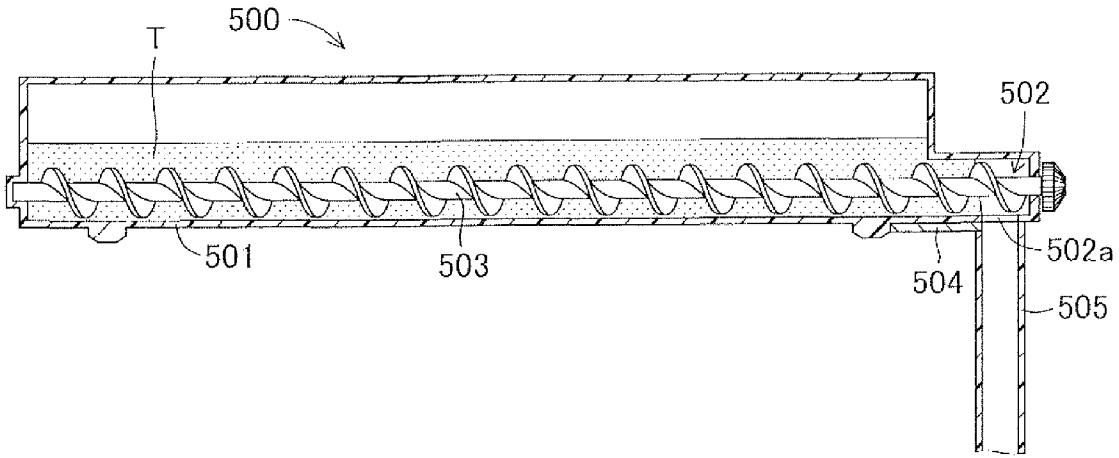
FIG. 9A PRIOR ART
Figure 9B:
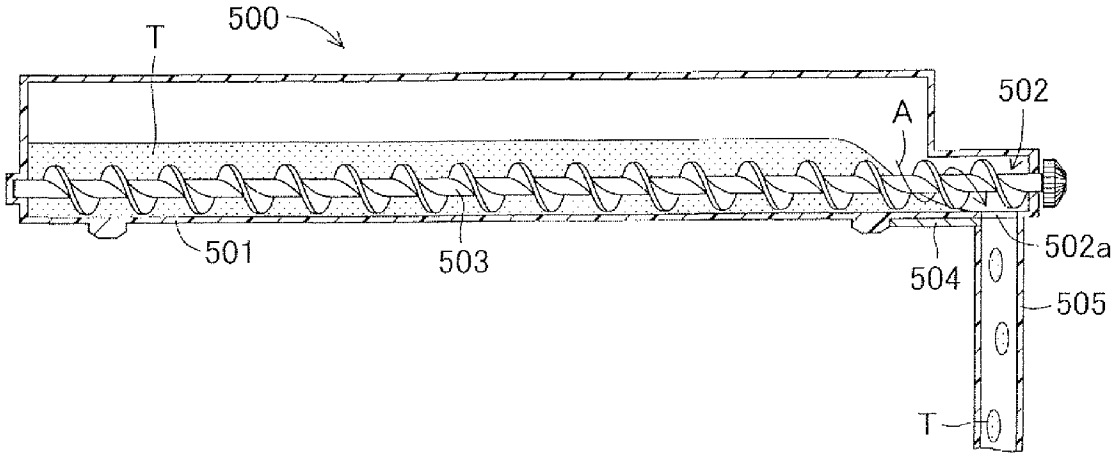
FIG. 9B PRIOR ART

Next, a configuration of the toner cartridges 14 to 17 will be specifically described by exemplifying the toner cartridge 14 for black with reference to FIGS. 3, 4, 5A, 5B, 6A, 6B, 7A, 7B, and FIGS. 8A to 8B. Since the other toner cartridges 15 to 17 have the same configuration, the description thereof will be omitted in the description below. FIG. 3 is a cross-sectional view illustrating a state before the toner cartridge 14 is attached to the image forming apparatus 1, FIG. 4 is a cross-sectional view taken along the line IV-IV of FIG. 3, FIG. 5A is a cross-sectional view taken along the line V-V of FIG. 3, and FIG. 5B is a perspective view illustrating a configuration of a shutter opening and closing mechanism 100. Further, FIG. 6A is a cross-sectional view illustrating a procedure of an opening operation of a rotary shutter 146 and similar to FIG. 5A, and FIG. 6B is a perspective view illustrating an operation state of the shutter opening and closing mechanism 100 corresponding to the operation procedure of the rotary shutter 146. Furthermore, FIG. 7A is a cross-sectional view illustrating a state where the rotary shutter 146 is opened and similar to FIG. 5A, and FIG. 7B is a perspective view illustrating an operation state of the shutter opening and closing mechanism 100 while the rotary shutter 146 is opened. FIGS. 8A to 8C are schematic plan views each illustrating an operation state of the rotary shutter 146 and the shutter opening and closing mechanism 100 respectively shown in FIGS. 5A, 5B, 6A, 6B, 7A, and 7B.

As shown in FIGS. 3, 4, 5A, 6A, and 7A, the toner cartridge 14 includes the toner containing section 140 for containing a toner, a screw member 141, a toner discharging unit 142 having a toner discharging port 142*a*, a slide shutter 143, an agitating paddle 144, a bearing member 145, and a rotary shutter 146. The toner containing section 140 has, at one end thereof, a substantially cylindrical toner discharging unit 142 having a keyhole-shaped cross-section, and is a substantially rectangular column shaped toner container for containing a toner and rotatably supports the screw member 141 and the agitating paddle 144 therein.

The screw member 141 includes a rotary shaft 141*a*, a spiral blade 141*b*, and a driving gear 141*c*, and transports the toner inside the toner containing section 140 toward the toner discharging port 142*a* by the rotation thereof. The agitating paddle 144 is an agitating member which has one agitating blade on the rotary shaft, and serves to crumb the toner inside the toner containing section 140 and to push the toner toward the screw member 141 by the rotation thereof. The toner discharging port 142*a* is a quadrangle opening which is formed in the bottom portion of the toner discharging unit 142 of the toner containing sections 140, and through which the toner transported by the screw member 141 is discharged to the outside of the toner cartridge 14. The slide shutter 143 is a substantially quadrangular-plate-like opening and closing valve member which is provided to be slidable at a position where a lower end opening of the toner discharging port 142*a* is closed. The slide shutter 143 is so configured that, when the slide shutter 143 is set to the image forming apparatus 1 along the direction depicted by the arrow F as shown in FIGS. 2 and 3, a protrusion 143*a* comes into contact with a fixed contact portion (not shown) disposed in the image forming apparatus 1 and thereby the slide shutter slides in the direction reverse to the direction depicted by the arrow F through the reaction thereof and the lower end opening of the toner discharging port 142*a* is opened. The toner discharging port 142*a* of which the lower end opening is opened is aligned with an upper end opening of the toner supply pipe 10 (refer to FIG. 1), so that there is achieved a state where the toner may be supplied from the interior of the toner containing section 140 to the developing device 6 (refer to FIG. 1) via the toner supply pipe 10.

Although the toner cartridges 14 to 17 are attached to the toner cartridge unit 37 as shown in FIG. 2, at this time, a coupling portion of each agitating paddle is coupled to a driving transmission mechanism (not shown) disposed in the stopper plate 37*e* of the toner cartridge unit 37, whereby there is configured a driving transmission system from a driving source (not shown) disposed inside a body of the image forming apparatus 1 to each agitating paddle. Then, the driving is further transmitted from each agitating paddle to each screw member. Specifically, in a configuration shown in FIG. 3, a timing belt 141*d* is wound on the driving gear 141*c* and a driving gear (not shown) attached to the adjacent agitating paddle 144, and thereby the driving is transmitted from the agitating paddle 144 and the screw member 141 is rotated, about a rotation axial line L thereof.

The rotary shutter 146 is formed in a circular-arc-shaped cross-section which has the same curvature center as that of the cylindrical portion of the toner discharging unit 142 and of which the outer peripheral diameter is substantially equal to or slightly smaller than the inner peripheral diameter of the cylindrical portion of the toner discharging unit 142 to open and close the upper end opening of the toner discharging port 142*a*, and is configured to be rotatable about the rotation axial line L. Then, the rotary shutter 146 is configured to be opened by the shutter opening and closing mechanism 100 which is operated in conjunction with the rotation of the screw member 141. The shutter opening and closing mechanism 100 holds the rotary shutter 146 at a position where the toner discharging port 142*a* is closed, releases a closed state in conjunction with the initial rotation of the screw member 141, and then holds the rotary shutter at a position where the toner discharging port 142*a* is opened.

That is, the shutter opening and closing mechanism 100 includes a claw piece 101, an operation piece 102, first and second engaging notch portions 103 and 104. The claw piece 101 is an elastically deformable member fixed to one side of the rotary shutter 146 to extend in the rotation direction thereof. The operation piece 102 is fixed to the rotary shaft 141*a* of the screw member 141 and operates on the claw piece 101. The first and second engaging notch portions 103 and 104 are disposed at a predetermined distance from each other in a circumferential direction of in the bearing member 145. A length of the first engaging notch portion 103 along the direction of the rotation axial line L is set to be shorter than a length of the second engaging notch portion 104, and the predetermined distance between the first and second engaging notch portions 103 and 104 in the circumferential direction is set to be substantially the same as an arc length of the rotary shutter 146. The claw piece 101 comprises an arm portion 105 and a claw portion 106. The arm portion 105 is an elastically deformable member which extends from one side of the rotary shutter 146 in the rotation direction of the screw member 141. The claw portion 106 is formed at a front end of the arm portion 105 to have a T-shape. The claw portion 106 comprises a claw tip portion 106*a* which has a triangular shape in a plan view and a claw base portion 106*b*. The claw tip portion 106*a* is fitted in and engaged with one of the engaging notch portions 103 and 104 along the direction of the rotation axial line L. The operation piece 102 is formed of a plate-like piece, and is fixed to the rotary shaft 141*a* of the screw member 741 so that a plate surface thereof is formed along the direction of the rotation axial line L and upright in a radial direction. The operation piece 102 includes a higher-level portion 102*a* and a lower-level portion 102*b* so that a distal end thereof is formed in a step shape (refer to FIGS. 7B and 8C). An upright height of the higher-level portion 102*a* of the operation piece 102 from the rotary shaft 141*a* is set to a height in which the higher-level portion may overlap with the claw base portion 106*b* of the claw portion 106 in the rotation direction of the screw member 141, and an upright height of the lower-level portion 102*b* is set to a height in which the lower-level portion does not interfere with the claw base portion 106*b*.

In the shutter opening and closing mechanism 100 with such a configuration, when the claw tip portion 106*a* of the claw portion 106 in the claw piece 101 is engaged with the first engaging notch portion 103, the claw base portion 106*b* of the claw portion 106 in the claw piece 101 is located at a position where the claw piece is operable by the higher-level portion 102*a* of the operation piece 102 and the closed state of the toner discharging port 142*a* using the rotary shutter 146 is maintained. Then, the claw base portion 106*b* of the claw piece 101 is operated by the higher-level portion 102*a* of the operation piece 102 with the initial rotation of the screw member 141, and the claw portion 106 is propelled in the rotation direction and an engaging state of the claw tip portion 106*a* with respect to the first engaging notch portion 103 is released. The rotary shutter 146 opens the toner discharging port 142*a* in accordance with this operation. Subsequently, the claw tip portion 106*a* is engaged wits the second engaging notch portion 104 with the rotation of the screw member 141, so that the claw base portion 106*b* of the claw piece 101 is retreated from the position where the claw piece is operable by the higher-level portion 102*a* of the operation piece 102 and an opening state of the toner discharging port 142*a* using the rotary shutter 146 is maintained.

An operation of opening the rotary shutter 146 using the shutter opening and closing mechanism 100 will be specifically described by referring to the drawings. In FIGS. 8A to 8C, the spiral blade 141*b* of the screw member 141 is depicted by the two-dotted chain line for convenience of description. As shown in FIGS. 5A, 5B, and 8A, when the toner cartridge 14 is packaged, the claw tip portion 106*a* is fitted in and engaged with the first engaging notch portion 103, and the rotary shutter 146 is maintained to close the toner discharging port 142*a*. In this state, since a depth of the first engaging notch portion 103 along the rotation axial line P is small, the arm portion 105 of the claw piece 101 is greatly elastically deformed to the opposite side of the bearing member 145, and the claw base portion 106*b* of the claw portion 106 is positioned to the higher-level portion 102*a* of the operation piece 102 to overlap on an upstream side of the screw member 141 in the rotation direction thereof. At this time, since the rotary shutter 146 is set to a position where the toner discharging port 142*a* is closed, even when the slide shutter 143 opened as described above when the toner cartridge 14 is set to the body of the image forming apparatus, the toner inside the toner cartridge 14 does not flow into the toner supply pipe 10 (refer to FIG. 1).

Next, when the driving gear 141*c* start to rotate in response to the toner supply signal from the body of the image forming apparatus 1, as shown in FIGS. 6A, 6B, and 8B, the higher-level portion 102*a* of the operation piece 102 integrally fixed to the screw member 141 is operated to press the claw base portion 106*b* of the claw portion 106 in the direction depicted by the arrow (the rotation direction of the screw member 141). In accordance with this operation, the engaging state of the claw tip portion 106*a* with respect to the first engaging notch portion 103 is released. At the same time, the claw tip portion 106*a* elastically and slidably moves along an end surface of the bearing member 145 facing an inside of the toner containing section 140 in the direction depicted by the arrow, and the rotary shutter 146 starts to rotate in the same direction. The toner discharging port 142*a* starts to be opened with the rotation of the rotary shutter 146, and at the same time, the toner starts to be supplied.

When the screw member 141 is rotationally driven by a predetermined rotation angle, as shown in FIGS. 7A, 7B, and 8C, the claw tip portion 106*a* of the claw portion 106 is fitted in and engaged with the second engaging notch portion 104. Since a depth of the second engaging notch portion 104 along the rotation axial line L is set to be large, the arm portion 105 of the claw piece 101 is displaced toward the bearing member 145 by the elastic restoration force, and in accordance with the displacement, the claw base portion 106*b* of the claw portion 106 deviates from a position where the claw base portion overlaps with the higher-level portion 102*a* of the operation piece 102, so that the claw base portion and the higher-level portion are not operated. At this time, the rotary shutter 146 is fully opened. Accordingly, even when the screw member 141 is rotated by the toner supply signal from the body of the image forming apparatus 1, the claw portion 106 is not operated by the operation piece 102, and the rotary shutter 146 maintained in a fully opened state. Also, an appropriate amount of the toner may be supplied to the developing device 6 via the toner supply pipe 10 by the rotation of the screw member 141.

During a time when the initial rotation of the screw member 141 is started after the toner containing section 140 is set to a predetermined position of the image forming apparatus 1 by the operation of opening the rotary shutter 146 using the above-described shutter opening and closing mechanism 100, the toner avalanche phenomenon is prevented. Accordingly, an excellent toner leakage preventing mechanism with a simple configuration may be configured. The other toner cartridges 15 to 17 are also respectively provided with the toner leakage preventing mechanisms, thereby preventing the toner avalanche phenomenon caused by a vibration or the like after the toner cartridge is set to a predetermined position of the image forming apparatus 1.

Incidentally, the image forming apparatus 1 of the embodiment is a full-color image forming apparatus, but may be a monochrome image forming apparatus. Further, a full-color image forming system is also not limited to the exemplified tandem system, but may be another system. Furthermore, an example has been described in which a two-component developer is used in the developing device, but the developing device may use a nonmagnetic one-component developer.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A toner cartridge, comprising:

a toner containing section which contains a toner therein;

a toner discharging section which is disposed in one side of the toner containing section and has a toner discharging port;

a screw member which is disposed inside the toner containing section and transports a toner inside the toner containing section toward the toner discharging section;

a bearing member which holds an end of the screw member;

a shutter member which is disposed in the toner discharging section to be rotatable about a rotation axial line of the screw member and has a circular-are-shaped cross-section; and a shutter opening and closing mechanism which opens the shutter member in conjunction with rotation of the screw member, the shutter opening and closing mechanism including:

a claw piece which has a claw portion fixed to the shutter member;

an operation piece which is disposed in the screw member and presses the claw piece; and two engaging notch portions disposed at a distance from each other in a circumferential direction of the bearing member, the claw portion being engaged with one of the two engaging notch portions, wherein the claw portion of the claw piece is engaged with a first engaging notch portion of the two engaging notch portions, the claw piece is located at a position where the claw piece is operable by the operation piece and a closed state of the toner discharging port using the shutter member is maintained, and wherein when the screw member starts to rotate, the operation piece presses the claw piece, and engaging state of the claw portion with respect to the first engaging notch portion is released, the shutter member opens the toner discharging port in conjunction with rotation of the screw member, and then the claw portion of the claw piece is engaged with a second engaging notch portion of the two engaging notch portions by the rotation of the screw member and the claw piece is retreated from a position pressed by the operation piece and an opening state of the toner discharging port using the shutter member is maintained.

2. The toner cartridge of claim 1, wherein the shutter opening and closing mechanism holds the shutter member at a position where the toner discharging port is closed, releases a closed state of the toner discharging port in conjunction with initial rotation of the screw member, and then holds the shutter member at a position where the toner discharging port is opened.

3. The toner cartridge of claim 1, wherein a length of the first engaging notch portion along the rotation axial line is shorter than a length of the second engaging notch portion along the rotation axial line.

4. The toner cartridge of claim 1, wherein the claw piece is formed of an elastically deformable member.

5. An image forming apparatus employing electrophotography, comprising;

a photoreceptor drum on which an electrostatic latent image is to be formed;

a developing device which forms a toner image by supplying a toner to the electrostatic latent image formed on a surface of the photoreceptor drum;

the toner cartridge of claim 1, the toner cartridge supplying a toner to the developing device via a toner supply member;

a transfer device which transfers the toner image on the surface of the photoreceptor drum to a recording medium; and a fixing device which fixes the toner image onto the recording medium.

* * * * *